US006811304B2

(12) United States Patent
Manaka

(10) Patent No.: US 6,811,304 B2
(45) Date of Patent: Nov. 2, 2004

(54) ANALOG ELECTRONIC TIMEPIECE

(75) Inventor: Saburo Manaka, Chiba (JP)

(73) Assignee: Seiko Instruments Inc., Chiba (JP)

( * ) Notice: Subject to any disclaimer, the term of this patent is extended or adjusted under 35 U.S.C. 154(b) by 171 days.

(21) Appl. No.: 10/140,709

(22) Filed: May 8, 2002

(65) Prior Publication Data

US 2002/0172099 A1 Nov. 21, 2002

(30) Foreign Application Priority Data

May 17, 2001 (JP) ..... 2001-147826

(51) Int. Cl.[7] ..... G04C 9/00
(52) U.S. Cl. ..... 368/187; 368/80
(58) Field of Search ..... 368/76, 80, 108, 368/157, 187

(56) References Cited

U.S. PATENT DOCUMENTS

| | | | | |
|---|---|---|---|---|
| 3,998,043 A | | 12/1976 | Tamaru et al. | 58/23 |
| 4,212,158 A | | 7/1980 | Tamaru | 368/80 |
| 6,021,097 A | * | 2/2000 | Kanno et al. | 368/64 |
| 6,327,225 B1 | * | 12/2001 | Okeya et al. | 368/157 |
| 6,339,306 B1 | * | 1/2002 | Hara | 318/696 |
| 6,414,908 B1 | * | 7/2002 | Kurasawa | 368/80 |

FOREIGN PATENT DOCUMENTS

| | | |
|---|---|---|
| CH | 0268902 | 6/1950 |
| EP | 0841603 | 5/1998 |

* cited by examiner

*Primary Examiner*—David Martin
*Assistant Examiner*—Thanh S. Phan
(74) *Attorney, Agent, or Firm*—Adams & Wilks

(57) ABSTRACT

To enable to easily stop a second hand at a 0 second position even in an analog electronic timepiece operating a hand at a high period. A dividing circuit outputs a low frequency pulse signal and a high frequency pulse signal at predetermined frequencies to a control circuit. The control circuit outputs the low frequency pulse signal of 4 pulses per second aligned at equal intervals when it is detected by a detecting circuit that an operating portion is not operated and outputs repeatedly the high frequency pulse signal of consecutive 4 pulses at every second when it is detected by the detecting circuit that the operating portion is operated. A motor driving circuit and a motor normally operate a second hand in response to the low frequency pulse signal and repeats, at a period of 1 second, operation of fast feeding the second hand and thereafter stopping the second hand during a predetermined period of time in response to the high frequency pulse signal.

6 Claims, 1 Drawing Sheet

ANALOG ELECTRONIC TIMEPIECE

BACKGROUND OF THE INVENTION

1. Field of the Invention

The present invention relates to an analog electronic timepiece for indicating time by driving to rotate a time hand based on a pulse signal and setting time of the time hand by stopping to operate the time hand by predetermined operation.

2. Description of the Prior Art

Conventionally, there has been used an analog electronic timepiece for indicating time by driving to rotate a time hand by a motor based on a pulse signal.

When time of an analog electronic timepiece is set, as a method of accurately setting even a second hand, in order to set the second hand to accurate second, there is provided a method of setting an hour/minute hand in a state in which the second hand is made stationary at a 0 second position (0 second prescription).

In order to carry out the 0 second prescription, by inputting a reset signal to an integrated circuit used in an electronic timepiece by carrying out operation of pulling a crown or the like, a drive pulse for operating the second hand is stopped to thereby stop the second hand at the 0 second position.

In order to stop the second hand at the 0 second position as described above, the second hand needs to be stopped at the 0 second position by counting a timing and when the second hand passes through the 0 second position by losing the timing, one must await for 1 minute until the second hand arrives again at the 0 second position.

Particularly, in the case of an electronic timepiece for operating the second hand at a high period of plural steps (for example, 4 steps or more) in 1 second (high period operation), there poses a problem that it is difficult to accurately stop the second hand at the 0 second position.

It is a problem of the invention to be capable of easily stopping a second hand at a 0 second position even in an analog electronic timepiece for carrying out high period operation.

SUMMARY OF THE INVENTION

According to the invention, there is provided an analog electronic timepiece characterized in that in an analog electronic timepiece for indicating time by driving to rotate a time hand based on a pulse signal and setting time of the time hand by stopping to operate the time hand by a predetermined operation, the analog electronic timepiece comprising an operating portion, detecting means for detecting operation of the operating portion, pulse generating means for repeatedly outputting a pulse signal of a predetermined pulse number per a predetermined time period, and motor driving means for controlling to rotate a motor for driving to rotate a second hand by a number in correspondence with the pulse number of the pulse signal received from the pulse generating means, wherein the pulse generating means outputs a first pulse signal of a predetermined pulse number per the predetermined time period aligned at equal intervals repeatedly at every time of the predetermined time period when it is detected by the detecting means that the operation of the operating portion is not operated and outputs a second pulse signal concentrated with pulses of the predetermined number in a predetermined range within the predetermined time period repeatedly at every time of the predetermined time period when it is detected by the detecting means that the operation of the operating portion is operated.

The pulse generating means repeatedly outputs the first pulse signal of the predetermined pulse number per the predetermined time period aligned at equal intervals when it is detected by the detecting means that the operation of the operating portion is not operated and outputs the second pulse signal concentrated with the predetermined number of pulses in the predetermined range within the predetermined time period when it is detected by the detecting means that the operation of the operating portion is operated, repeatedly at every time of the predetermined time period. Thereby, when the operation of the operating portion is not operated, the second hand is driven to rotate at equal speed and when the operating portion is operated, the second hand repeatedly carries out operation of stopping for a constant time period after having been operated at high speed.

In this case, there may be constructed a constitution in which the pulse generating means comprises pulse forming means for forming a low frequency pulse signal at a predetermined frequency and a high frequency pulse signal at a frequency higher than the predetermined frequency of the low frequency pulse signal and controlling means for selectively passing the low frequency pulse signal and the high frequency pulse signal in accordance with a detection result of the operation of the operating portion by the detecting means, the controlling means outputs the low frequency pulse signal of the predetermined pulse number as the first pulse signal at every time of the predetermined time period when it is detected by the detecting means that the operation of the operating portion is operated and outputs the consecutive high frequency pulse signals in a predetermined range as the second pulse signal at every time of the predetermined time period such that a pulse number per the predetermined time period becomes equal to a number of the first pulse signal when it is detected by the detecting means that the operation of the operating portion is operated.

Further, there may be constructed a constitution in which the operating portion is operated by other operation different from the operation and the pulse generating means stops outputting the pulse signal when it is detected by the detecting means that the operating portion is operated by the other operation, to thereby stop rotating the motor.

Further, there may be constructed a constitution in which the operating portion is constituted by a crown and the pulse generating means outputs the second pulse signal when it is detected by the detecting means that the crown is operated by a one stage pulling operation.

Further, there may be constructed a constitution in which the pulse generating means stops outputting the pulse signal when it is detected by the detecting means that the crown is operated by a two stages pulling operation.

Further, the predetermined time period may be one second.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A detailed explanation will be given of embodiments of the invention in reference to the drawings as follows.

Figure 1:
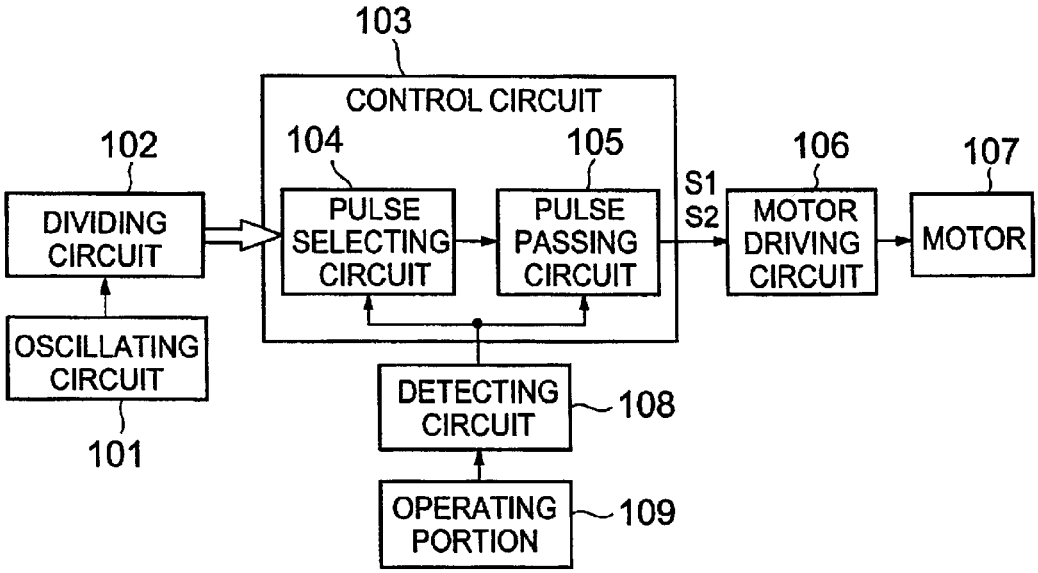
FIG. 1 is a block diagram of an analog electronic timepiece according to an embodiment of the invention.

FIG. 1 is a block diagram of an analog electronic timepiece according to an embodiment of the invention, showing an example of an analog electronic wrist watch of a high period operation system for indicating 1 second by driving a second hand by 4 steps.

In FIG. 1, an oscillating circuit 101 is connected to one input portion of a control circuit 103 via a dividing circuit 102. An operating portion 109 is connected to other input portion of the control circuit 103 via a detecting circuit 108 constituting detecting means. Further, an output portion of the control circuit 103 is connected to a motor 107 for driving a time hand (second hand, minute hand, hour hand) via a motor driving circuit 106 constituting motor driving means. The motor 107 is a step motor generally used for a timepiece.

The operating portion 109 is constituted by a member operable from outside and can use a well-known crown mechanism capable of carrying out, for example, 2 stages pulling operation and capable of setting time by rotating an hour/minute hand by operating to rotate the hour/minute hand in a state of carrying out the 2 stages pulling operation. According to the embodiment, an explanation will be given of an example of using the crown as the operating portion 109.

The detecting circuit 108 is a circuit for detecting that the operating portion 109 is operated and is constituted by, for example, a detection switch for detecting, when the operating portion 109 is the crown, that the crown is not operated to pull and which of operations of 1 stage pulling operation and 2 stages pulling operation, is carried out.

The oscillating circuit 101 and the dividing circuit 102 constitute pulse generating means and the dividing circuit 102 divides a pulse signal generated by the oscillating circuit 101, generates a low frequency pulse signal at a predetermined frequency and high frequency pulse signal at a frequency higher than that of the low frequency pulse signal and outputs the low frequency pulse signal and the high frequency pulse signal to the control circuit 103.

The control circuit 103 constituting the control meansis provided with a pulse selecting circuit 104 for selectively passing the low frequency pulse signal and the high frequency pulse signal in accordance with a detection result of operation of the operating portion 109 by the detecting circuit 108 and a pulse passing circuit 105 for switching a time width of passing a pulse signal from the pulse selecting circuit 104 in accordance with the detection result of the operation of the operating portion 109 by the detecting circuit 108.

The control circuit 103 repeatedly outputs a pulse signal of a predetermined pulse number (4 pulses according to the embodiment) per a predetermined time period (1 second according to the embodiment) and repeatedly outputs a first pulse signal S1 aligned with low frequency pulse signals of the predetermined number per the predetermined time period at every time of the predetermined time period when it is detected by the detecting circuit 108 that the operating portion 109 is not operated and repeatedly outputs a second pulse signal S2 concentrated with the predetermined number of high frequency pulse signals in a predetermined range shorter than the predetermined time period within the predetermined time period at every time of the predetermined time period when it is detected by the detecting circuit 108 that first operation of the operating portion 109 (1 stage pulling operation of the crown according to the embodiment) is carried out. Further, the control circuit 103 is constituted such that the pulse signal is not outputted when it is detected by the detecting portion 108 that second operation of the operating portion 109 (2 stage pulling operation of the crown according to the embodiment) is carried out.

Further, the oscillating circuit 101, the dividing circuit 102 and the control circuit 103 constitute pulse generating means.

Figure 2:
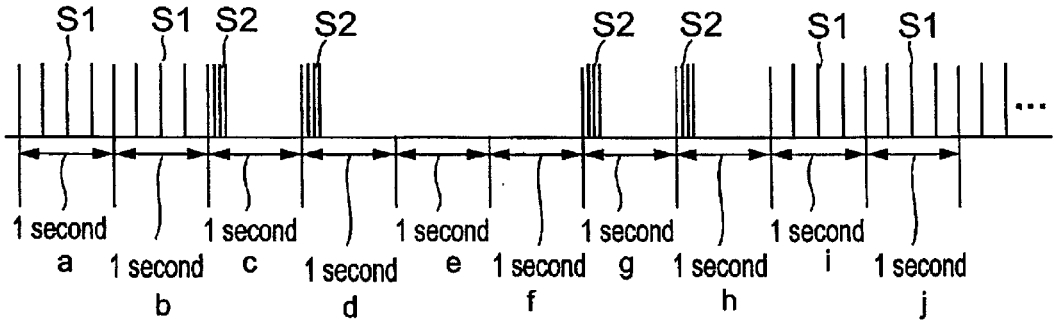
FIG. 2 is a timing chart of the analog electronic timepiece according to the embodiment of the invention.

FIG. 2 is a timing chart for explaining operation of the embodiment, showing timings of signals outputted from the control circuit 103.

An explanation will be given of operation of the embodiment in reference to FIG. 1 and FIG. 2 as follows.

As an initial state, the dividing circuit 102 is brought into a state of dividing the pulse signal at the predetermined frequency generated by the oscillating circuit 101 and outputting the low frequency signal at the predetermined frequency and the high frequency pulse signal at the frequency higher than that of the low frequency signal to the control circuit 103. Further, the operating portion 109 is brought into not carrying out operation, that is, a state in which time is indicated by normally operating the time hand (second hand, minute hand, hour hand).

Under the state, the detecting circuit 108 is brought into a state of outputting a detection signal detecting that the operating portion 109 is not operated. The pulse selecting circuit 104 selects the low frequency pulse signal and outputs the low frequency signal to the pulse passing circuit 105. The pulse passing circuit 105 repeatedly outputs the first pulse signal S1 aligned at equal intervals of a number of 4 pulses per second at every second. That is, the pulse passing circuit 105 outputs the low frequency pulse signal inputted from the pulse selecting circuit 104 as it is without imposing any restriction to the motor driving circuit 106. Thereby, from the control circuit 103, the first pulse signal S1 aligned at equal intervals of 4 pulses per second, is repeatedly outputted to the motor driving circuit 106 at every second (a, b of FIG. 2). The motor driving circuit 106 control the rotation of the motor 107 based on the first pulse signal S1. As a result, the second hand indicates 1 second by 4 steps.

Under the state, when the 1 stage pulling operation (first operation) of the operating portion 109 is carried out, the detecting circuit 108 detects that the operating portion 109 is operated by the 1 stage pulling operation and outputs a first detection signal indicating that the operating portion 109 is operated by the 1 stage pulling operation to the control circuit 103.

The pulse selecting circuit 104 selects the high frequency pulse in response to the first detection signal and outputs the high frequency pulse signal to the pulse passing circuit 105. The pulse passing circuit 105 repeatedly outputs a second pulse signal concentrated with 4 pulses in the predetermined range of 1 second at every second in response to the first detection signal. That is, the pulse passing circuit 105 switches a time width of passing pulses to pass only first consecutive 4 pulses/second in the high frequency pulse signals inputted from the pulse selecting circuit 104. Thereby, as shown by FIGS. 2*c, d*, from the control circuit 103, the second pulse signal S2 comprising the first consecutive 4 pulses in the high frequency pulse signals, is outputted to the motor driving circuit 106 repeatedly at every second.

The motor driving circuit 106 controls to rotate to fast feed the motor 107 based on the second pulse signal S2 of 4 pulses/second, thereafter stops rotating the motor during a predetermined time period until a successive one of the pulse signal S2 arrives and repeats the operation thereafter. As a result, the second hand indicates 1 second by 4 steps and at every second, the second hand is fed fast by an amount of 1 second during a time period in which the second pulse signal S2 is present and is brought into a state of stopping the second hand during a remaining time period in which the second pulse signal is not present.

Therefore, when the second hand arrives at the 0 second position, by operating the operating portion 109 by the 1 stage pulling operation, the second hand can easily be stopped at the 0 second position during a time period of 1 second or less.

Next, when the operating portion 109 is operated further by the 1 stage pulling operation (that is, 2 stages pulling operation (second operation)), the detecting circuit 108 detects that the operating portion 109 is operated by the 2 stages pulling operation and outputs the second detection signal indicating that the operating portion 109 is operated by the 2 stages pulling operation to the control circuit 103. The pulse passing circuit 105 is operated to cut the high frequency pulse signal inputted from the pulse selecting circuit 104 in response to the second detection signal. Thereby, as shown by FIGS. 2*e, f*, the second pulse signal S2 is not outputted from the control circuit 103, thereby, rotation of the motor 107 is stopped and operation of the time hands including the second hand is stopped.

Therefore, by carrying out the 2 stages pulling operation when the secondhand arrives at the 0 second position, the second hand can easily be stopped at the 0 second position.

Under the state, by operating to rotate the operating portion 109, the hour/minute hand can be set to accurate time.

Thereafter, when the operating portion 109 is operated by 1 stage returning operation (operation of returning to the 1 stage pulling state), the detecting circuit 108 detects the operation and outputs the first detection signal, thereby, the pulse passing circuit 105 carries out the above-described operation and therefore, the second pulse signal S2 is outputted from the control circuit 3 (FIGS. 2*g, h*), and the above-described fast feeding and stopping operation of the second hand is repeatedly carried out.

From the state, when the operating portion 109 is operated further by the 1 stage returning operation (operation of returning to a state of not carrying out pulling operation), as shown by FIGS. 2*i, j*, the timepiece returns to normal operation of indicating time.

As described above, according to the embodiment of the invention, particularly, there is provided an analog electronic timepiece characterized in that in an analog electronic timepiece for indicating time by driving to rotate a time hand based on a pulse signal and setting time of the time hand by stopping to operate the time hand by a predetermined operation, the analog electronic timepiece comprising the operating portion 109, the detecting circuit 108 for detecting operation of the operating portion 109, pulse generating means(the oscillating circuit 101, the dividing circuit 102, the control circuit 103) for repeatedly outputting a pulse signal of a predetermined pulse number per a predetermined time period, and motor driving means for controlling to rotate a motor for driving to rotate a second hand by a number in correspondence with the pulse number of the pulse signal received from the pulse generating means, wherein the pulse generating means outputs a first pulse signal of a predetermined pulse number per the predetermined time period aligned at equal intervals repeatedly at every time of the predetermined time period when it is detected by the detecting circuit 108 that the operating portion 109 is not operated and outputs a second pulse signal concentrated with pulses of the predetermined number in a predetermined range shorter than the predetermined range within the predetermined time period repeatedly at every time of the predetermined time period when it is detected by the detecting circuit 108 that the operating portion 109 is operated.

Therefore, even in the analog electronic timepiece for operating the hand at the high period, the second hand can easily be made to stop at the 0 second position and time can be set accurately even for the second hand.

Further, although it is difficult to maintain to indicate second accurately in the case of a mechanical type timepiece, in the case of the analog electronic timepiece of a high period hand operating system according to the embodiment, even when the second hand resembling that of the mechanical type timepiece is operated, time can be indicated accurately even for the second hand.

Further, there is constructed a constitution by the pulse selecting circuit 104 for passing a plurality of frequency pulse signals inputted from the dividing circuit 102 selectively in accordance with the detection result of the detecting circuit 108 and the pulse passing circuit 105 for passing only pulses within the predetermined time period width in the respective predetermined time period of pulse signals from the pulse selecting circuit 104 in accordance with the detection result of the detecting circuit 108 and therefore, the embodiment can be realized by a simple constitution.

Further, although according to the embodiment, the crown is used as the operating portion 109 for simplifying the constitution, other operating portion may be provided.

Further, although according to the embodiment, there is constructed a constitution in which first 4 pulses of the high frequency pulse signal are outputted at every time of the predetermined time period, for example, by constructing a constitution in which last 4 pulses thereof are outputted at every time of the predetermined time period, consecutive pulses of a predetermined number within the predetermined time period width in the respective predetermined time period may be outputted.

Further, although a motor for driving the time hand, that is, a single motor for serving to drive to rotate the second hand, the minute hand and the hour hand is used for the motor 107, various modifications can be carried out such that a motor for driving only the second hand and a motor for driving the hour/minute hand are used and only the second hand is controlled to drive as described above.

According to the invention, even in an analog electronic timepiece for operating a hand at a high period, a second hand can easily be stopped at a 0 second position and time can accurately be set even for the second hand.

What is claimed is:

1. An analog electronic timepiece characterized in that in an analog electronic timepiece for indicating time by driving to rotate a time hand based on a pulse signal and setting time of the time hand by stopping to operate the time hand by a predetermined operation, the analog electronic timepiece comprising:

an operating portion;

a detecting circuit for detecting operation of the operating portion;

a pulse generating circuit for repeatedly outputting a pulse signal of a predetermined pulse number per a predetermined time period; and a motor driving circuit for controlling to rotate a motor for driving to rotate a secondhand by a number in correspondence with the pulse number of the pulse signal received from the pulse generating circuit;

wherein the pulse generating circuit outputs a first pulse signal of a predetermined pulse number per the predetermined time period aligned at equal intervals repeatedly at every time of the predetermined time period when it is detected by the detecting circuit that the operation of the operating portion is not operated and outputs a second pulse signal concentrated with pulses of the predetermined number in a predetermined range within the predetermined time period repeatedly at every time of the predetermined time period when it is detected by the detecting circuit that the operation of the operating portion is operated.

2. The analog electronic timepiece according to claim 1, characterized in that the pulse generating circuit comprises pulse forming circuit for forming a low frequency pulse signal at a predetermined frequency and a high frequency pulse signal at a frequency higher than the predetermined frequency of the low frequency pulse signal and a controlling circuit for selectively passing the low frequency pulse signal and the high frequency pulse signal in accordance with a detection result of the operation of the operating portion by the detecting circuit;

wherein the controlling circuit outputs the low frequency pulse signal of the predetermined pulse number as the first pulse signal at every time of the predetermined time period when it is detected by the detecting circuit that the operation of the operating portion is operated and outputs the consecutive high frequency pulse signals in a predetermined range as the second pulse signal at every time of the predetermined time period such that a pulse number per the predetermined time period becomes equal to a number of the first pulse signal when it is detected by the detecting circuit that the operation of the operating portion is operated.

3. An analog electronic timepiece according to claim 1, wherein the operating portion is operated by other operation different from the operation and the pulse generating circuit stops outputting the pulse signal when it is detected by the detecting circuit that the operating portion is operated by the other operation, to thereby stop rotating the motor.

4. The analog electronic timepiece according to claim 1, wherein the operating portion is constituted by a crown and the pulse generating circuit outputs the second pulse signal when it is detected by the detecting circuit that the crown is operated by a one stage pulling operation.

5. An analog electronic timepiece according to claim 4, wherein the pulse generating circuit stops outputting the pulse signal when it is detected by the detecting circuit that the crown is operated by a two stages pulling operation.

6. An analog electronic timepiece according to claim 1, wherein the predetermined time period is one second.

* * * * *